US007793793B1

(12) United States Patent
Sykes

(10) Patent No.: US 7,793,793 B1
(45) Date of Patent: Sep. 14, 2010

(54) JEWELRY DISPLAY HOLDER

(76) Inventor: Helen K. Sykes, 11 Newell Rd., Derry, NH (US) 03038

( * ) Notice: Subject to any disclaimer, the term of this patent is extended or adjusted under 35 U.S.C. 154(b) by 0 days.

(21) Appl. No.: 12/497,633

(22) Filed: Jul. 3, 2009

(51) Int. Cl.
*A47F 7/02* (2006.01)
*A47G 29/00* (2006.01)

(52) U.S. Cl. ..... 211/85.2; 211/163; 211/181.1; 206/6.1; 248/309.1

(58) Field of Classification Search ..... 206/6.1, 206/205, 301, 553, 566, 581, 457; D9/651; 211/163, 85.2, 195, 196, 205, 74, 85.23, 211/85.18, 85.31, 181.1, 198; 248/309.1, 248/309.2; D8/373
See application file for complete search history.

(56) References Cited

U.S. PATENT DOCUMENTS 1,112,558 A * 10/1914 Red ..... 248/129
1,797,077 A * 3/1931 Dew et al. ..... 248/121
1,897,905 A * 2/1933 Johnson ..... 248/121
D250,686 S * 1/1979 Ashcraft ..... D6/458
4,390,099 A * 6/1983 Trautlein et al. ..... 211/4
6,050,529 A * 4/2000 Lin ..... 248/121
6,241,105 B1 * 6/2001 Pomper ..... 211/85.2
D450,225 S * 11/2001 Walters-Dowding et al. . D7/704
7,451,882 B2 * 11/2008 McKay ..... 211/85.2

* cited by examiner

*Primary Examiner*—Mickey Yu
*Assistant Examiner*—Chun Cheung

(57) ABSTRACT

A jewelry display holder includes at least three inverted U-shaped parts connectable to each other, a platform, a base, rings, and earring holder. The inverted U-shaped parts being are placed on the platform, and each of the inverted U-shaped parts has substantially parallel and uneven legs and arch-like transversal portion. Shorter legs in the inverted U-shaped parts lean against each other, whereas longer legs stand on the platform. The longer legs are equidistant from each other and give support to the inverted U-shaped parts. Additional display elements made as S-shaped hooks are attached to the arch-like transversal portions of the inverted U-shaped parts. The platform is made rotatable relative to the base, the rings are mounted via extensions between the legs in each of the inverted U-shaped parts and differ from each other by the height at which they are installed.

1 Claim, 5 Drawing Sheets

JEWELRY DISPLAY HOLDER

FIELD OF THE INVENTION

The present disclosure generally relates to an arrangement for storing, organizing and displaying ornaments, and more specifically to such fixtures for trinkets, bijouterie, or jewelry.

BACKGROUND OF THE INVENTION

Known from U.S. Design Pat. No. D329,763 issued 29 Sep. 1992 to Raymond J. Cuminale is a jewelry display stand, which includes a slope plane attached to a horizontal base and vertical supporting plane, the item to be displayed being placed on the slope surface.

Disclosed in U.S. Design Pat. No. D350,864 issued 27 Sep. 1994 to Elizabeth Kane et al. is a jewelry display stand, which comprises three tower-like structures and three vertical stands between the structures, all six being installed on a round rotatable platform attached to a base having drawers and provided with wheels.

A jewelry display device is disclosed in U.S. Pat. No. 5,899,343 issued 4 May 1999 to Robert P. Franklin et al. A stand-up, book-like jewelry display device has a rectangular frame mounted upright on a horizontal bracket. Product panels that hold jewelry and graphics panels that depict the jewelry in use are rotatably mounted within the frame so that each panel swings about one of its edges, thereby giving the display the appearance of a book with pages to turn. Preferably, the product panels are alternated within the frame. In addition, the graphics panels are preferably narrower than the product panels such that, other than the graphics panel within the "leaf" being viewed, each graphics panel is obscured by the product panel above it so that it does not block from view any jewelry displayed on the product panel below it. In addition, the upright frame may be rotatably mounted to the horizontal bracket such that the frame can be rotated to allow the salesperson to change the displays without having to turn the bracket. The frame may be locked in place by a peg that extends downward through the bottom portion of one side of the frame into a recess in the bracket.

A need exists for a jewelry display holder that would be easy to assemble and use.

SUMMARY OF THE INVENTION

This goal is attained by providing a jewelry display holder that has at least three inverted U-shaped parts connectable to each other, a platform, a base, and rings.

The inverted U-shaped parts are placed on the platform, and each of the inverted U-shaped parts having substantially parallel and uneven legs and arch-like transversal portion, shorter legs of each of the inverted U-shaped parts lean against each other, whereas longer legs stand on the platform, being circumferentially equidistant from each other and giving support to the inverted U-shaped parts. Ends of the longer legs of the inverted U-shaped parts are S-shaped.

Additional display elements made as S-shaped hooks can be attached to the arch-like transversal portions of the inverted U-shaped parts.

The platform is made rotatable relative to the base, the rings are mounted via extensions between the legs in each of the inverted U-shaped parts differing from each other by the height at which they are installed.

The above-identified features of the holder are believed to ensure the creation of a novel storage unit that would save consumers valuable time by keeping jewelry organized, as well as readily accessible.

BRIEF DESCRIPTION OF THE DRAWINGS

Other objects, features and advantages of the disclosure will become apparent to one skilled in the art by reading the following specification and subjoined claims and by referencing the following drawings, in which:

DETAILED DESCRIPTION OF THE PREFERRED EMBODIMENT

Figure 1:
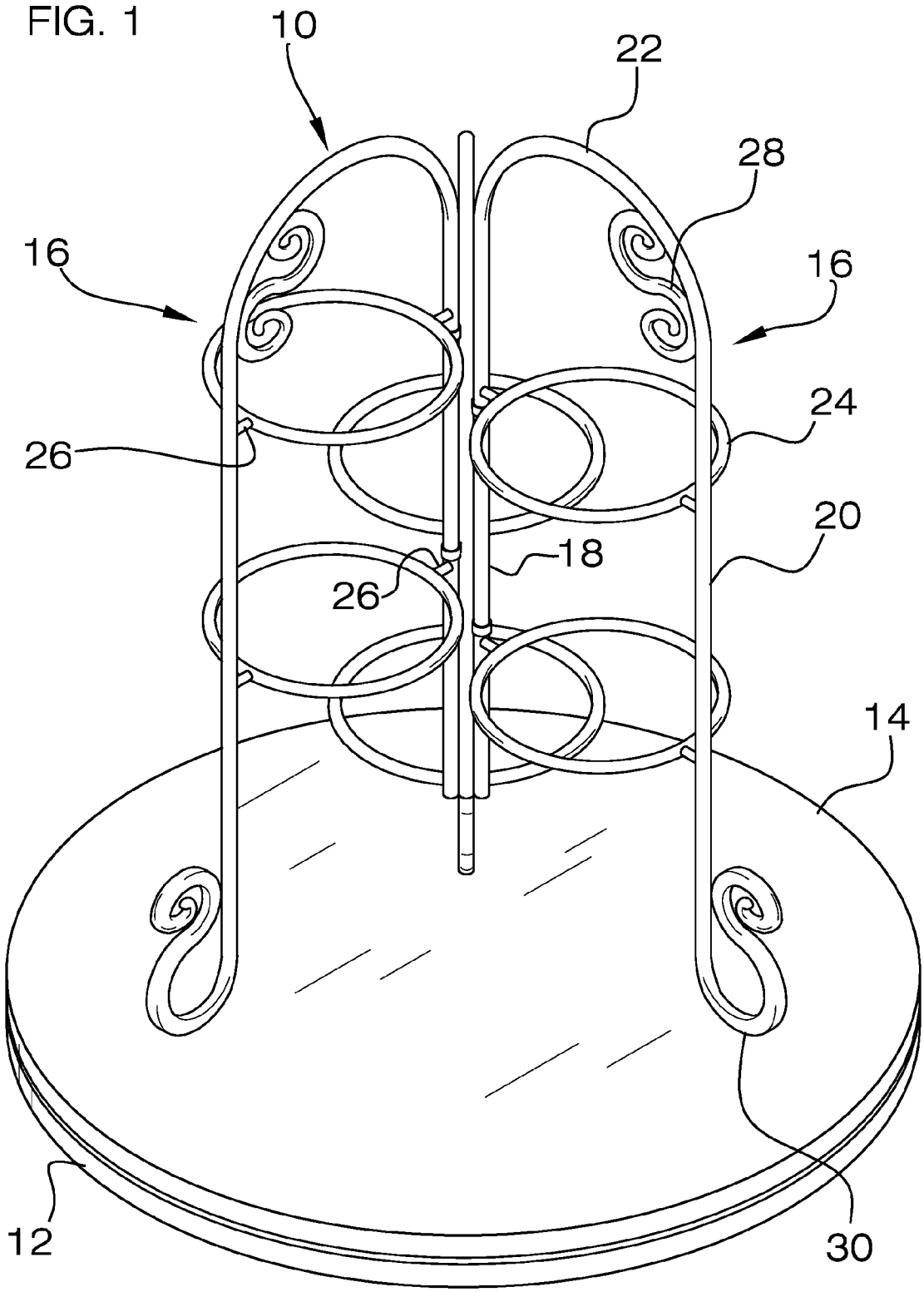
FIG. 1 is a perspective view of a jewelry display holder according to the present disclosure.
Figure 2:
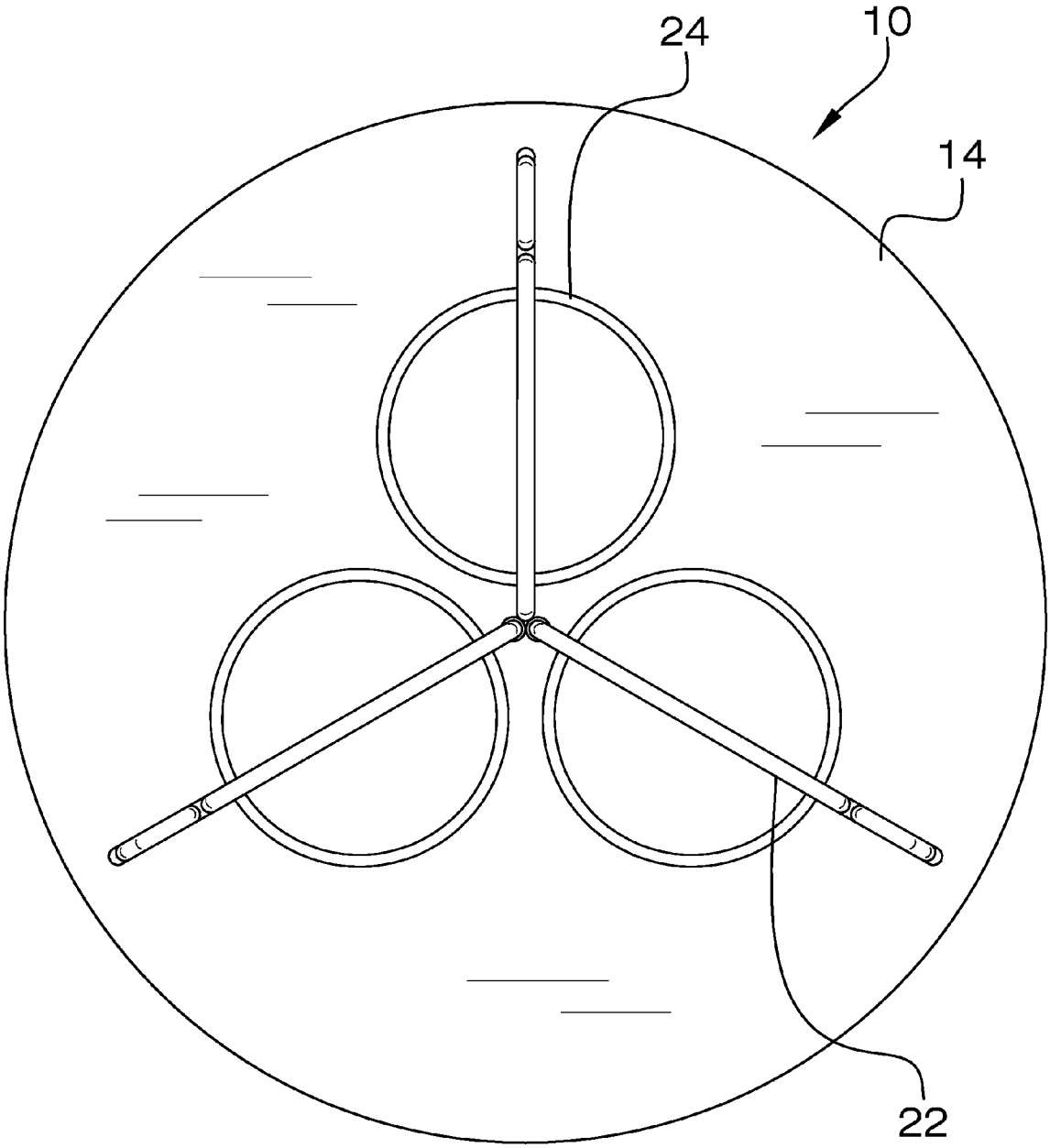
FIG. 2 is a top view of the holder according to the present disclosure.
Figure 3:
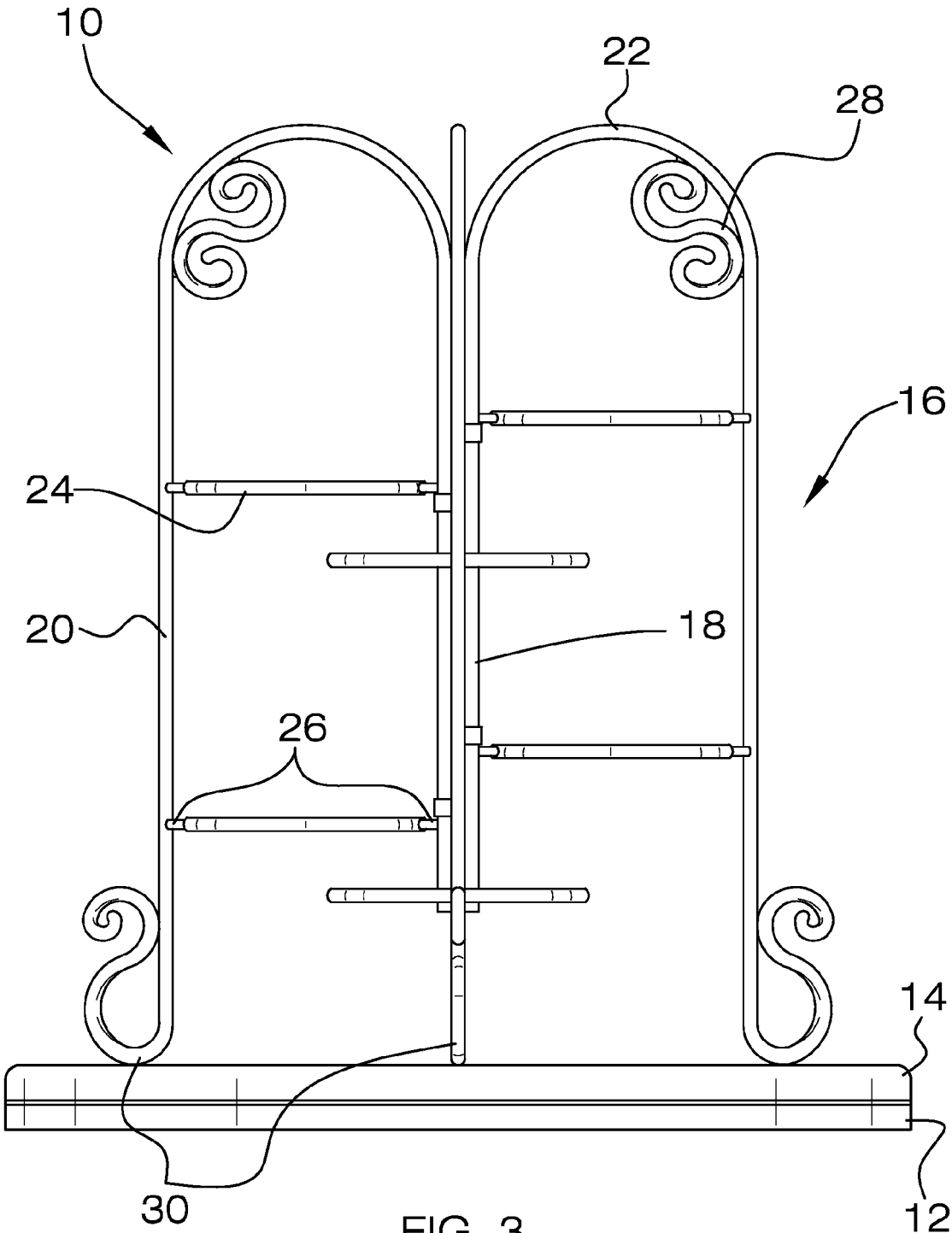
FIG. 3 is a back view of the holder.

Before starting a detailed description of the disclosure, mention of the following is in order. When appropriate, like reference numerals and characters may be used to designate identical, corresponding, or similar components in different figure drawings.

Referring now to the drawings of FIGS. 1-5, a jewelry display holder 10 comprises a base 12, on which a rotatable plastic or wood platform 14 is installed. Positioned atop the platform 14 is a plurality of, preferably three, inverted U-shaped parts 16, which can also be called oval arches. The parts 16 that can be made from plastic or green vinyl coated, heavy duty steel wire to match the entire display, could be connected together to form a storage area for jewelry items. Each of the inverted U-shaped parts 16 comprises a shorter leg 18, a longer leg 20, and a transversal portion 22. The shorter legs 18 of the inverted U-shaped parts 16 lean against, and thus support, each other. The longer legs 20 stand on the platform 14 and are (circumferentially) equidistant from each other. In this way, they also give support to the inverted U-shaped parts 16.

Positioned within each inverted U-shaped part 16 at various height would be two circles (rings) 24. The circles 24 could be covered in a soft felt or they may be silver- or gold-plated metal for a shiny appearance. The circles are preferably connected to the inverted U-shaped parts 16 by means of extensions 26 that can be, for example, ¾" long. Incorporated near the transversal portion 22 in each of the inverted U-shaped parts 16 is an additional display element 28 that can be made as a S-shaped hook. Ends 30 of the longer legs of the inverted U-shaped parts can be of various shapes, for example S-shaped as shown in the drawings.

The platform 14 can be of a circular or square shape, the platform being rotatable allows the individual to easily view and select the desired accessory. A quantity of necklaces could be hung from the rings. While it would be possible to produce the holder in various sizes to house different quantities of jewelry, a standard version could measure 11½" in diameter, with a height of 22½". The holder could be produced in a plethora of colors including white and black to coordinate with an array of decors.

Arch oval shaped earring holders are producible to accommodate the display of earrings. They are plastic earring holders, which are arch oval shape, includes a slight curvature at the top to conform to the circular design of the jewelry display holder. The small holes at the bottom are for earring attachment. These holes is approx. ⅛" so that earrings can easily be inserted. They are positioned about ¼" from the bottom and sides. See diagram below for shape and measurements. The arch oval shape earring holder is applied to the circles of jewelry display holder by slipping between the middle of the rounded bottom of the holder and onto the circle of the jewelry display holder. The round on the top of the hook is small to ensure a tight fit. These plastic earring holders may be made in black, forest green, or in a soft felt, or silver-or-gold to match circles and frame of jewelry display holder. The measurements of the earring holder are as follows: ¼" from the top to the top bottom, the top of the loop is ¾" from left to right, the height is approximately 1¾", the width of each round bottom end is ¾" from its widest part and the ⅛" hole is placed in the center of each round bottom end ¼" from the edge.

The display holder according to the present disclosure is believed to satisfy the need for a original storage unit that would save consumers valuable time by keeping jewelry organized, as well as readily accessible. This product could provide a fashionable and practical means to store a wide array of accessories. The appealing features of the display stand would be its eye-catching design, attractiveness, convenience, ease of use, and ability to store an entire collection of jewelry in one easily accessible location. Thus, the individual would not have to spend a great deal of time looking through jewelry boxes or drawers filled with tiny jewelry boxes searching for a misplaced necklace, earrings, bracelet, etc. This product could store the accessories in a safe fashion, which could reduce the incidence of items being damaged or tangled. Thus, its use could save the consumer the money that may have been expended to repair or replace jewelry or accessories. Furthermore, it could group various articles of jewelry together as a means to save time when selecting accessories.

Figure 4:
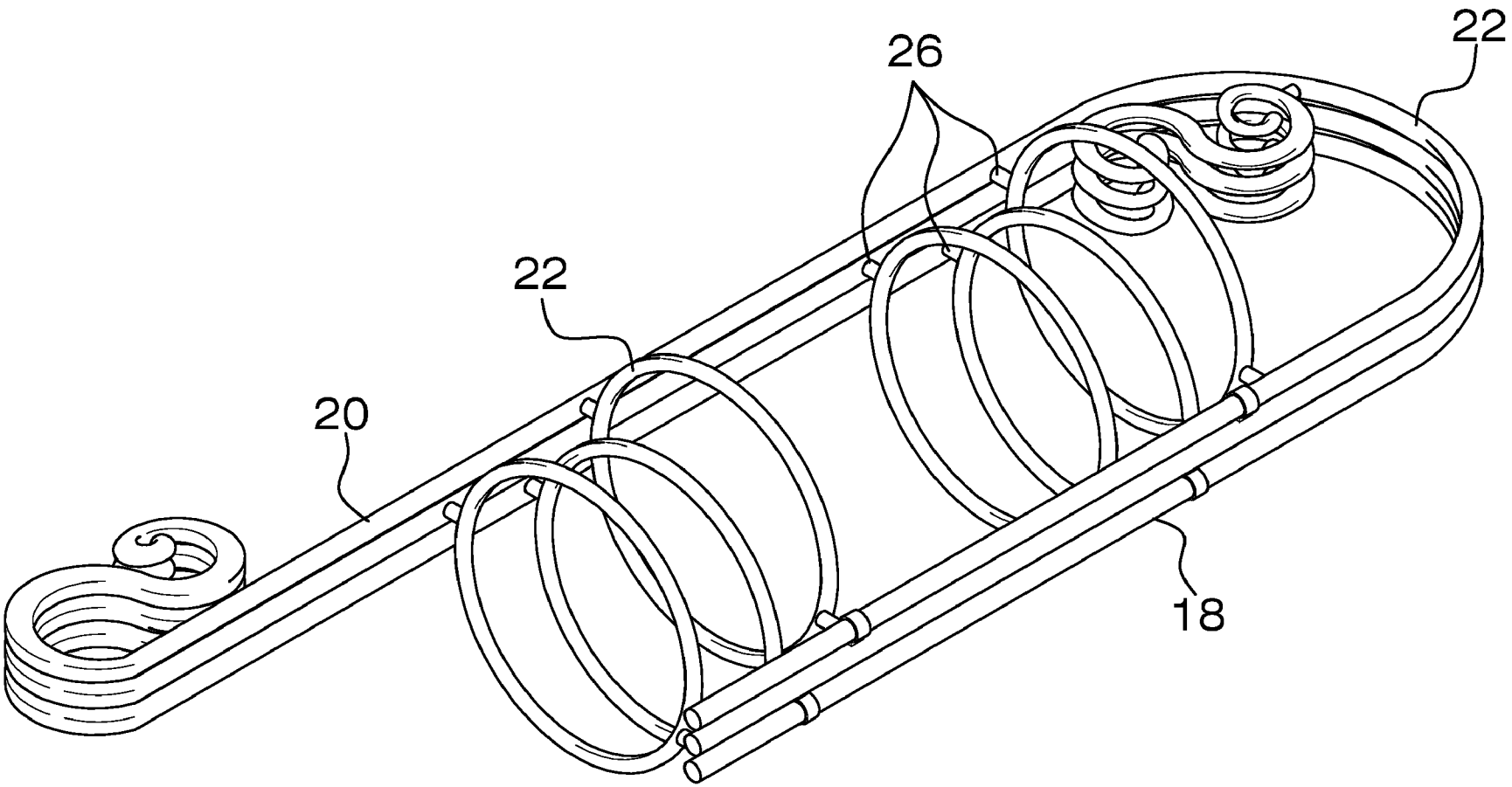
FIG. 4 is a perspective view of the holder according to the present disclosure, in its folded position.
Figure 5:
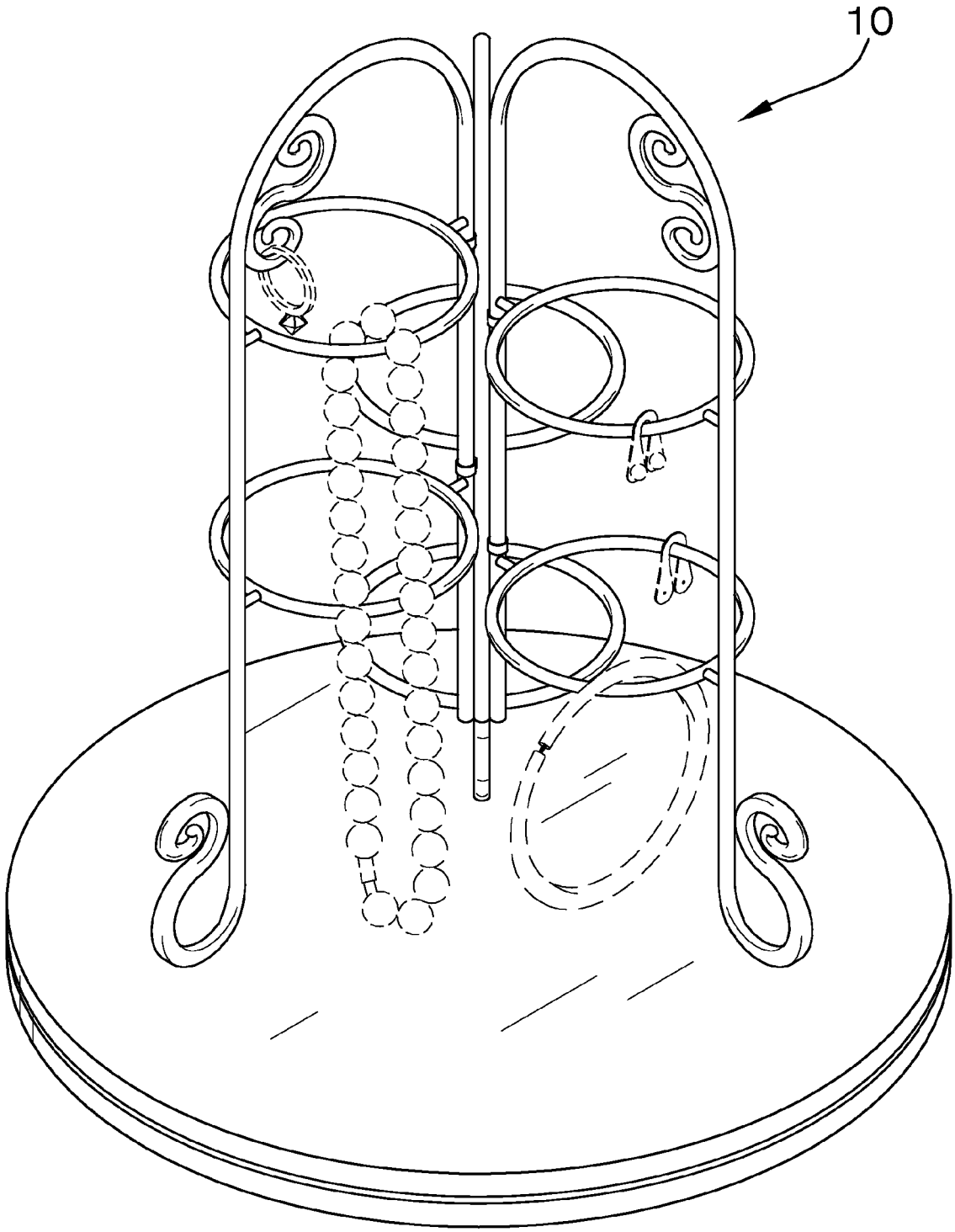
FIG. 5 is a perspective view of the holder according to the present disclosure, when the holder is in use.

This display holder is eye-catching thanks to its unusual structural design. In addition, this attractive jewelry display holder satisfies a need to which one can present jewelry for sale or display in boutiques, department stores, jewelry stores, gift shops, outlets, and various retail locations. It may garner a great deal of attention and would be quit a conversational piece. This product could also fold into a compact unit as needed, which is illustrated in FIG. 4. The display holder would be versatile in that it could be positioned in multiple locations throughout a home, especially the bedrooms or dressing rooms. It could display numerous articles of jewelry in a reasonable amount of space to allow easy accessibility and viewing when coordinating an outfit. Many homeowners, retailers, and businesses would find a need for this unique, desirable, and practical jewelry display holder.

Those skilled in the art can now appreciate from the foregoing description that the broad teachings of the present disclosure can be implemented in a variety of forms. Therefore, while the jewelry display holder of the present disclosure has been described in connection with a particular example thereof, the true scope of the disclosure should not be so limited since other modifications will become apparent to the skilled practitioner upon a study of the drawings, specification and claims that follow.

What is claimed is:

1. A jewelry display holder comprising at least three inverted U-shape parts connectable to each other, a platform, a base, and rings, the inverted U-shape parts being placed on the platform, each of the inverted U-shape parts having substantially parallel and uneven legs and arch-like transversal portion, shorter legs of each of the inverted U-shape parts leaning against each other, longer legs of the inverted U-shape parts standing on the platform, being circumferentially equidistant from each other and giving support to the inverted U-shape parts, ends of the longer legs of the inverted U-shape parts being S-shape, additional display elements made as S-shape hooks being attached to the arch-like transversal portions of the inverted U-shape parts, the platform being made rotatable relative to the base, the rings being mounted via extensions between the legs in each of the inverted U-shape parts and differing from each other by the height at which they are installed.

* * * * *